United States Patent [19]

Lee

[11] Patent Number: 5,043,547

[45] Date of Patent: Aug. 27, 1991

[54] TEMPERATURE SENSOR CONNECTING DEVICE FOR MICROWAVE OVEN

[75] Inventor: Kwan H. Lee, Kyongsangnam-Do, Rep. of Korea

[73] Assignee: Goldstar Co., Ltd., Rep. of Korea

[21] Appl. No.: 496,970

[22] Filed: Mar. 21, 1990

[51] Int. Cl.[5] ..... H05B 6/74; H05B 6/78

[52] U.S. Cl. ..... 219/10.55 B; 219/10.55 E; 219/10.55 F; 374/149; 374/154; 374/155

[58] Field of Search ..... 219/10.55 E, 10.55 F, 219/10.55 R, 10.55 B; 374/149, 153, 154, 155

[56] References Cited

U.S. PATENT DOCUMENTS

| | | | |
|---|---|---|---|
| 4,149,056 | 4/1979 | Kaneshiro et al. | 219/10.55 R |
| 4,334,137 | 6/1982 | Takagi et al. | 219/10.55 F |
| 4,339,647 | 7/1982 | Inayama et al. | 219/10.55 R |
| 4,427,866 | 1/1984 | Pauly et al. | 219/10.55 B |
| 4,429,204 | 1/1984 | McGuire | 219/10.55 F |
| 4,547,643 | 10/1985 | Yamauchi | 219/10.55 R |
| 4,632,128 | 12/1986 | Paglione et al. | 219/10.55 F |
| 4,691,087 | 9/1987 | Lee | 219/10.55 B |

*Primary Examiner*—Philip H. Leung

*Attorney, Agent, or Firm*—Anthony J. Casella; Gerald E. Hespos

[57] ABSTRACT

A temperature sensor connecting device for a microwave oven integrating a stirrer fan on the ceiling is arranged to plug a temperature sensor through the stirrer fan shaft into a recepticle provided on the external side of the top cover so that the temperature sensor inserted in the food on a turntable rotates following the rotation of the food under heating with no cause of twisting.

6 Claims, 2 Drawing Sheets

TEMPERATURE SENSOR CONNECTING DEVICE FOR MICROWAVE OVEN

FIELD OF THE INVENTION

DETAILED DESCRIPTION OF THE INVENTION

The present invention relates to a device for connecting a temperature sensor, to a microwave oven, for sensing the temperature of the food under heating, in particular, to a device which inserts its connector plug through a shaft bearing tube, receiving over it the cylinder shaft of a stirrer fan provided on the ceiling of the cooking cavity, and rotatably keeps the plug in contact with a plug holder mounted on the outer cover to rotate so as not to twist the lead cord of the probe with the rotation of the turntable.

BACKGROUND OF THE INVENTION

In the conventional art, the connecting device of the temperature sensor for sensing the temperature of the food in cooking has on one end a temperature sensor 35 being inserted into the food 34 placed on a turntable 33 in the cooking cavity of a microwave oven 31 shown in FIG. 3 and on the other end of the cord 36 a temperature probe 37 and a plug 37' being received through an opening 39 of the ceiling 38 of the cooking cavity 32 into the plug holder 40 for contact with it. The conventional device is constructed as in the above that the rotation of the turntable 33 driven by the motor 41 also turns the food 34 with the inserted temperature sensor 35 to cause the lead cord 36 with its plug 37' of the temperature probe 37 rotate in the plug holder 40 so as not to twist the lead cord 36.

However, with a stirrer fan mounted on the top of the cooking cavity the arrangement in the conventional construction comes to be infeasible for practical application. In the event of mounting a stirrer fan on the ceiling of the cooking cavity, a plug holder 40 has to be provided on a side wall, thus, to make difficult the rotation of the temperature probe 37.

SUMMARY OF THE INVENTION

The present invention is designed to eliminate such the disadvantage as in the above conventional device and provides a connecting arrangement, for a temperature sensor in a microwave oven, in that a stirrer fan is mounted on a tube provided on the ceiling of the cooking cavity for the tube to receive a plug connector through its cylindrical opening to connect to a plug holder provided on the external side of the cover and smoothly rotate without any obstacle within the tube and the holder, with no cause of twisting for the cord and with a good effect of evenly spreading microwaves for even doneness of the food in cooking. Referring to the drawings, the invention shall be described in details.

FIG. 2(*b*) is an exploded perspective view of the components for fixing a stirrer fan according to the invention.

Figure 1:
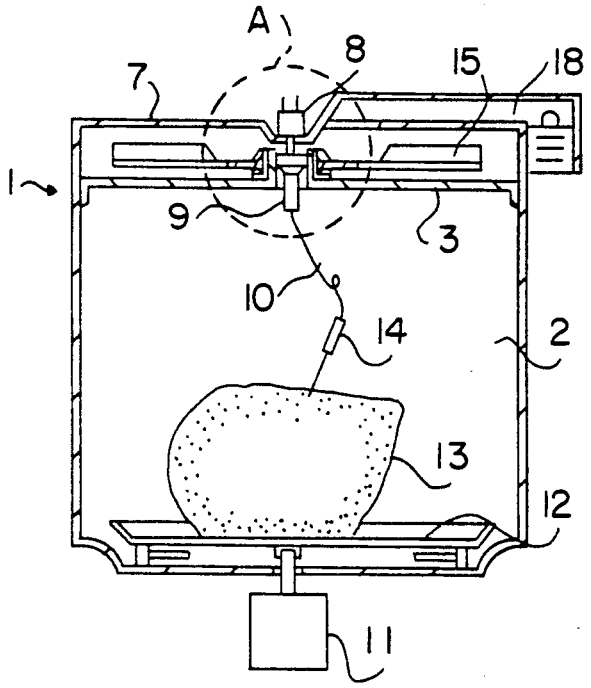
FIG. 1 is a cross-sectional view of a microwave oven and temperature sensor in accordance with the subject invention.
Figure 3:
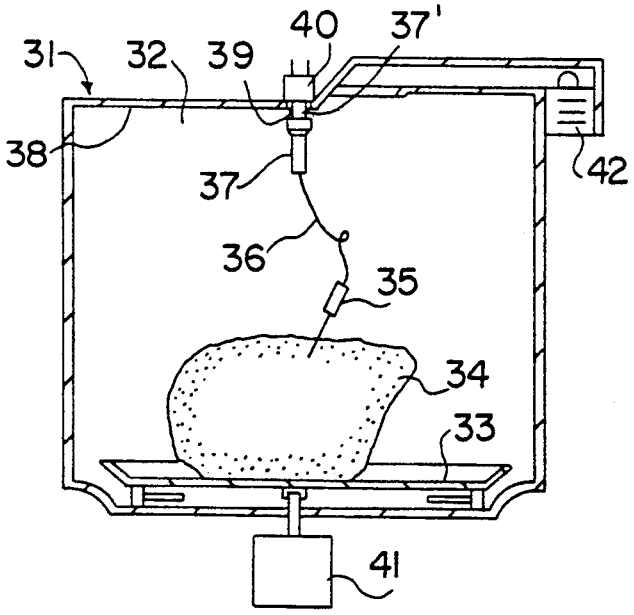
FIG. 3 (PRIOR ART)
FIG. 3 is a cross-sectional view of prior art device for connecting a temperature sensor to a microwave oven.
Figure 2B:
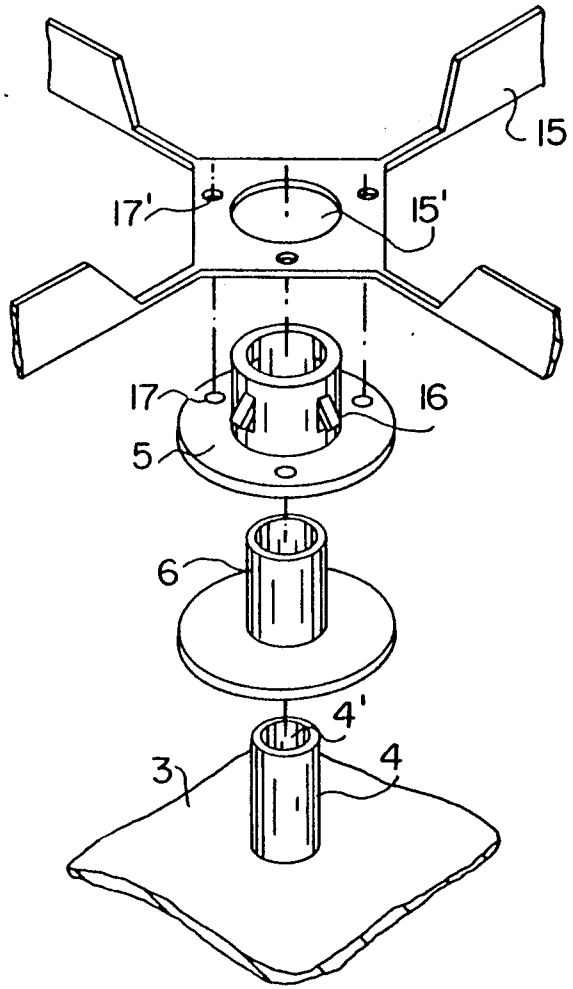
FIG. 2(*a*) is an enlarged cross-sectional view of area A in FIG. 1.
Figure 2A:
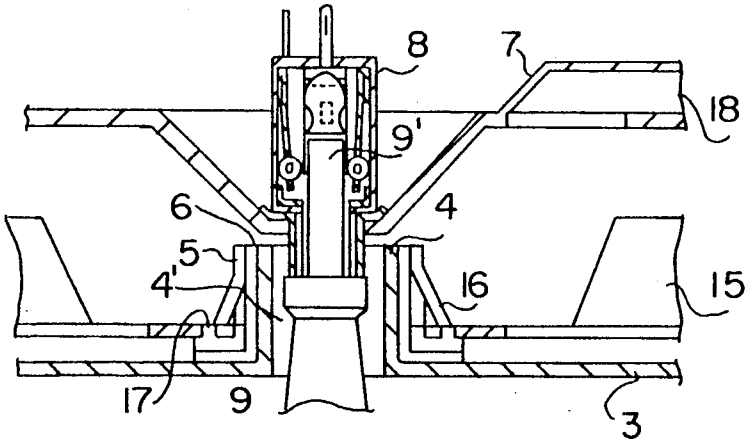

As shown in FIGS. 1 and 2, an embodiment of the invention is constructed such that a microwave oven 1 includes on the ceiling 3 of the cooking cavity 2 a cylindrical attachment 4 for fixing a bearing tube 6 receiving over it a stirrer fan shaft 5 and is also provided with a plug holder 8 mounted on the exterior of the top 7 of the oven cavity to receive and connect the plug 9' of the temperature probe 9 through the opening 4' of the tube 4.

The numeral codes unexplained indicate the following: Numeral 1 indicating a lead cord, 11 a motor, 12 a turntable, 13 food, 14 a temperature sensor, 15 stirrer fan, 15' an openings for fitting over the tube 5, 16 hook pins, 17 hook protrusions, 17' opening for inserting protrusions 17, 18 wave guide or a passage for microwaves.

The operation of the invention shall be described. With food 13 placed on the turntable 12 in the cooking cavity 2 of the inserted with a temperature sensor 14 and with the plug 9' of the temperature probe 9 connecting to the plug holder 8 through the tube 4, application of power to the oven 1 generates microwaves to guide through the passage wave guide 18 and spread the waves with the rotation of the stirrer fan 15 to apply over the whole of the food 13 which turns with the turntable 12 and with the sensor 14, whose lead cord 10 following the rotation with the plug 9' of the temperature probe 9 rotatably received into the plug holder 8 without twisting. Meanwhile, the food 13 under even application of the waves being spread by the stirrer fan 15 in a showerlike manner is cooked with even doneness for a good taste.

As shown above, the present invention employing a stirrer fan heats the food without twisting the lead cord of the temperature probe by means of connecting the cord with a plug passing through the stirrer shaft cylinder and achives even doneness of the food to enhance the performance of the oven.

I claim:

1. In a microwave oven having a cooking cavity, a turntable in the cooking cavity for receiving food to be cooked, means for rotating the turntable, a stirrer fan rotatable about an axis and disposed in proximity to the cooking cavity for contributing to distribution of microwaves, a stirrer fan cover disposed intermediate the cooking cavity and the stirrer fan, sensing means for sensing the internal temperature of the food on the turntable, said sensing means comprising a temperature sensor for insertion into the food, a cord extending from the temperature sensor and plug holder for rotatably receiving the cord, wherein the improvement comprises:

the stirrer fan cover being provided with an aperture;

a generally tubular bearing generally aligned with the aperture in the stirrer fan cover and on a side thereof opposite the cooking cavity;

a portion of the sensing means passing through the aperture and the tubular bearing; and the stirrer fan being rotatably mounted around the tubular bearing and around portions of the sensing means passing through the bearing whereby the sensing means is rotatable with the food on the turntable and substantially independent of the stirrer fan.

2. A temperature sensor and stirrer fan assembly as in claim 4 further comprising a generally tubular stirrer fan shaft coupled with the stirrer fan for rotation therewith, the stirrer fan shaft being rotatably mounted to the tubular bearing for achieving smooth rotation of the stirrer fan relative to the bearing.

3. A temperature sensor and stirrer fan assembly as in claim 2 wherein the stirrer fan comprises a generally planar central portion having a central aperture for receiving the stirrer fan shaft and a plurality of locking openings disposed around the central aperture, the stirrer fan shaft comprising a flange extending from the generally tubular portion thereof, said flange including a plurality of protrusions extending therefrom and dimensioned and aligned for engaging the locking openings in the central portion of the stirrer fan, said tubular shaft further comprising a plurality of hook pins for engaging the central portion of the stirrer fan and holding the central portion of the stirrer fan against the flange.

4. A temperature sensor and stirrer fan assembly as in claim 1 further comprising a cylindrical tube extending rigidly from the stirrer fan cover and in registration with the aperture therein, said tubular bearing being rotatably disposed over the tube, a portion of the sensing means passing through the tube.

5. A microwave oven comprising:

a cooking cavity;

a turntable in the cooking cavity for receiving food to be cooked;

means for rotating the turntable;

a stirrer fan cover disposed in generally opposed relationship to the turntable and defining a wall of the cooking cavity, said stirrer fan cover being provided with an aperture therethrough and a generally cylindrical tube extending away from the cooking cavity and in register with the aperture; a stirrer fan having a central aperture received over the tube of the stirrer fan cover, said stirrer fan being rotatable about the tube of the stirrer fan cover; and sensing means for sensing internal temperature of the food on the turntable, said sensing means comprising a temperature sensor disposed in the cooking cavity for insertion into the food, a plug holder disposed external of the cooking cavity and a cord extending therebetween for conveying temperature information from the temperature sensor to the plug holder, said cord being rotatable relative to the plug holder, a selected portion of said sensing means passing through the tube of the stirrer fan cover and through portions of the stirrer fan concentric with said tube such that said stirrer fan is rotatable without interference with the sensing means and such that the cord and temperature sensor of the sensor means are rotatable relative to the plug holder in response to rotation of the turntable for avoiding twisting of the cord.

6. A temperature sensor and stirrer fan assembly for a microwave oven, said microwave oven having a cooking cavity, said assembly comprising:

a tubular bearing having a central aperture extending therethrough, said central aperture providing communication to the cooking cavity of the microwave oven;

a stirrer fan having a central portion and a plurality of fan means extending outwardly therefrom for contributing to distribution of microwaves, said central portion of said stirrer fan including a central aperture rotatably mounted over the tubular bearing such that said stirrer fan is rotatable about the tubular bearing; and sensing means for sensing temperature of food being cooked in the microwave oven, said sensing means comprising a temperature sensor disposed in the cooking cavity for insertion into the food being cooked, a plug holder external of said cooking cavity and generally in register with the central aperture of the bearing and a cord connected to the plug holder and the temperture sensor, the cord being rotatable relative to the plug holder, portions of the sensing means passing through the central aperture of the tubular bearing and through the aperture in the central portion of the stirrer fan, such that the stirrer fan is rotatable without interference with the sensing means, and such that the cord and temperature sensor are rotatable relative to the plug holder without interference with the stirrer fan.

* * * * *